US007975439B1

(12) United States Patent
Cude

(10) Patent No.: US 7,975,439 B1
(45) Date of Patent: Jul. 12, 2011

(54) BULK STORAGE BUILDING

(76) Inventor: Herman E. Cude, Newbern, TN (US)

( * ) Notice: Subject to any disclaimer, the term of this patent is extended or adjusted under 35 U.S.C. 154(b) by 384 days.

(21) Appl. No.: 11/426,272

(22) Filed: Jun. 23, 2006

(51) Int. Cl.
*E04H 7/00* (2006.01)

(52) U.S. Cl. ..... 52/192; 52/293.1; 52/295; 52/296; 52/764; 52/780; 52/252; 52/92.2

(58) Field of Classification Search ..... 52/192, 52/292, 293.1, 294, 295, 296, 764, 780, 263, 52/251, 252, 270, 271, 90.1, 92.1, 92.2, 92.3, 52/93.1, 93.2; 220/4.28, 4.31, 565, 566, 220/567, 567.1, 567.2
See application file for complete search history.

(56) References Cited

U.S. PATENT DOCUMENTS

| | | | | | |
|---|---|---|---|---|---|
| 976,182 | A | * | 11/1910 | Jones | 52/252 |
| 1,114,584 | A | * | 10/1914 | Conzelman | 52/576 |
| 1,618,886 | A | * | 2/1927 | Peterson | 52/262 |
| 1,714,949 | A | * | 5/1929 | Collier et al. | 405/253 |
| 1,913,857 | A | * | 6/1933 | Scherer et al. | 62/414 |
| 2,057,018 | A | * | 10/1936 | Dillon | 256/19 |
| 2,748,592 | A | * | 6/1956 | Kelly | 52/169.9 |
| 3,237,357 | A | * | 3/1966 | Hutchings | 52/223.6 |
| 3,350,826 | A | * | 11/1967 | Hughes | 52/293.1 |
| 3,495,371 | A | * | 2/1970 | Mitchell, Jr. | 52/653.1 |
| 4,328,651 | A | * | 5/1982 | Gutierrez | 52/293.1 |
| 4,365,451 | A | * | 12/1982 | Nelson | 52/169.9 |
| 4,610,114 | A | * | 9/1986 | Rodriguez | 52/93.1 |
| 5,524,405 | A | * | 6/1996 | Byrd | 52/295 |
| 5,983,577 | A | * | 11/1999 | Hays | 52/79.1 |
| 6,460,309 | B1 | | 10/2002 | Schneider | 52/729.1 |
| 6,625,943 | B1 | * | 9/2003 | Renner | 52/251 |
| 2002/0166302 | A1 | * | 11/2002 | Ogorchock | 52/294 |

FOREIGN PATENT DOCUMENTS

| | | | | |
|---|---|---|---|---|
| JP | 10280542 | A | * | 10/1998 |
| JP | 2000160686 | A | * | 6/2000 |
| JP | 2000234387 | A | * | 8/2000 |

* cited by examiner

*Primary Examiner* — Robert J Canfield
*Assistant Examiner* — Jessie Fonseca
(74) *Attorney, Agent, or Firm* — Waddey & Patterson, P.C.; Phillip E. Walker

(57) ABSTRACT

A storage building for the storage of corrosive materials. The storage building comprises a floor, a plurality of columns extending from the floor, a plurality of crossbeams with each beam connecting at least two of the columns, a plurality of substantially vertically oriented supports extending from the crossbeams, a plurality of rafters attached to the supports and at least one roof panel spanning between two of the rafters.

16 Claims, 5 Drawing Sheets

BULK STORAGE BUILDING

I, Herman E. Cude, a citizen of the United States, residing at 1230 Cobb Road, Newbern, Tenn. 38059; have invented a new and useful "Improved Bulk Storage Building."

A portion of the disclosure of this patent document contains material that is subject to copyright protection. The copyright owner has no objection to the facsimile reproduction by anyone of the patent document or the patent disclosure, as it appears in the U.S. Patent and Trademark Office patent file or records, but otherwise reserves all copyright rights whatsoever.

All patents and publications described or discussed herein are hereby incorporated by reference in their entirety.

BACKGROUND OF THE INVENTION

In the construction industry, numerous people and entities are continuously trying to improve the technology in order to construct a better and/or cheaper building. These attempted improvements range from improved materials to improved construction assembly techniques to increased aesthetic appearances. Since the availability of land is a finite factor in the construction of buildings, one area of focus for improvement of construction is in the increased amount of building structure for a given footprint of the building. For example, skyscrapers have been one solution to this issue. However, these buildings are not designed for the bulk storage of materials, and therefore do not suit that purpose.

One area where a building for bulk storage of material that is needed is around waterways, such as rivers. Buildings are needed to store bulk materials near waterways, such as rivers, in the smallest footprint space as reasonably possible. An obvious reason for this is the limited amount of waterfront property available and the need for the building to be in close proximity thereto to allow unloading from and loading to vessels on the water.

The construction of these buildings is further complicated due to the fact that some industries required these buildings to store fertilizers and other corrosive materials that would normally damage or destroy the typical building materials.

An additional design criterion that should be met with these buildings is the fact that they must withstand the forces and/or pressures applied by the materials stored therein. Typically the average weight of some of the chemical fertilizers that are stored is around 60 pounds per cubic foot. As such, in a building of an appreciable size, once this material is piled upon itself, the force being applied to columns, the column footers, and the walls of the building can be significant and can lead to failure without the proper materials and construction of the building. Traditionally, the height of the buildings has been limited by these vast pressures placed on the building construction elements by the stored materials. Additionally, the angle of repose, which is typically defined as the angle at which a divided solid will stop flowing with the angle measured from the horizontal, also factors into the height limitations on the building due to the fact that the angle of repose for a given corrosive material dictates how high the material can be stacked.

A building design simply for storage can result in a very expensive building with a cost per ton of storage between the $60-$75 range. This cost is normally calculated exclusive of the cost to obtain the land, which since it is on a riverfront is normally expensive as well. As such, any increase in the storage capacity of the building while maintaining a small as possible footprint will greatly reduce the cost of the building.

Another drawback of the traditional building designs is the requirement of a slinger belt used to load the storage facility with the materials. Typically, a slinger belt has been positioned within the building thereby reducing the capacity of the building.

What is needed then is a storage building for corrosive materials that can approach an optimal storage capacity in the smallest footprint reasonably possible.

BRIEF SUMMARY OF THE INVENTION

Included herein is a storage building for the storage of corrosive materials. The storage building comprises a floor, a plurality of columns extending from the floor, a plurality of crossbeams with each beam connecting at least two of the columns, a plurality of substantially vertically oriented supports extending from the crossbeams, a plurality of rafters attached to the supports and at least one roof panel spanning between two of the rafters.

Each column includes a floor end and a roof end opposite the floor end. Each floor end includes a column keyway and the floor includes a plurality of floor keyways with each floor keyway designed to engage with one of the column keyways.

The floor further includes a plurality of footing sections wherein each footing section is positioned under one of the columns. At least one poured pad extends between the footing sections and the floor includes a top layer positioned over each footing section. Each top layer is positioned substantially planar with the at least one poured pad and the floor keyways are positioned in the top layers. The top layer and the poured pad do not overlap.

Each column includes at least two dowels wherein each dowel includes an upper end and a lower end. Each upper end is integrally formed within and extends from the floor end while in each lower end of each dowel is integrally formed within the floor. The lower end of each dowel is bent substantially perpendicularly to the upper end.

The building further includes a plurality of walls wherein each wall is connected to a column keyway of at least two columns that separates the storage building into bays. The building can also include a penthouse and material distribution equipment positioned substantially at the penthouse for distribution of the materials into the building.

A substantially horizontally oriented bearing plate can be positioned on the roof end of each column. Each bearing plate includes a substantially vertically oriented bars integrally formed within the roof end wherein one cross beam is connected to at least one of the bearing plates. A plurality of connection plates can also be included wherein each connection plate is positioned above one of the roof ends of a column and attaches adjacent cross beams.

The position of each top layer footing and poured pad can reduce the pressure imparted on the footing section and by the materials to less than approximately 2,000 pounds per square inch. Preferably this pressure is less than approximately 1,300 pounds per square inch. Additionally, the storage building can store corrosive materials approximately 50 feet high with an angle of repose between approximately 30 to approximately 60 degrees. Preferably this angle of repose is approximately 31 degrees.

It is therefore a general object of the present invention to provide improved storage building for the storage of corrosive materials.

Another object of the current invention is to provide a storage building having a floating footer design.

Yet another object of the current invention is to provide an improved storage building for the storage of corrosive materials where the pressure on footing sections by the material stored therein is less than 2,000 pounds per square inch.

Yet another object of the current invention is to provide an improved storage building for the storage of corrosive materials where the pressure on footing sections by the material stored therein is less than 1,300 pounds per square inch.

Still another object of the present invention is to provide a storage building having cross beams connecting each column of the building.

Yet still another object of the current invention is to provide a storage building having walls connected to keyways in the columns.

Another object of the current invention is to provide a storage building for corrosive materials that can store the materials approximately 50 feet high with angle of repose between approximately 30 degrees to approximately 60 degrees.

Another object of the present invention is to provide an improved storage building having a greater ton storage capacity with a smaller footprint than currently available.

Another object of the present invention is to provide a storage building having material loading equipment positioned in the top of the building to increase storage capacity.

Other and further objects, features and advantages of the present invention will be readily apparent to those skilled in the art upon reading of the following disclosure when taken in conjunction with the accompanying drawings.

DETAILED DESCRIPTION OF THE INVENTION

Figure 1:
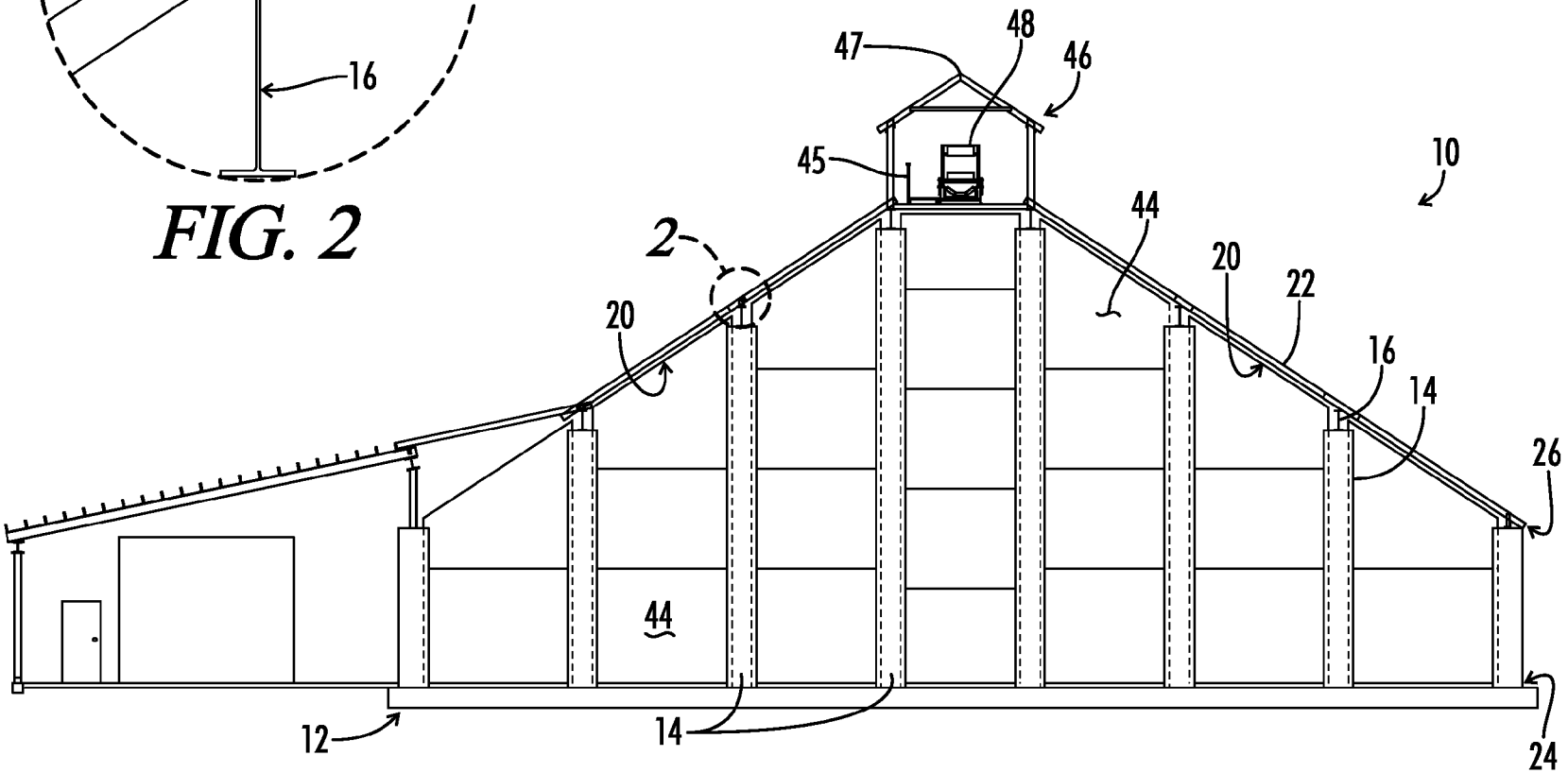
FIG. 1 is a schematic side view of a building made in accordance with the current disclosure.

Referring generally now to FIGS. 1-8, a storage building is shown and generally designated by the numeral 10. The storage building 10 is preferably for the storage of corrosive materials, such as chemical fertilizer and the like. The storage building 10 comprises a floor 12, a plurality of columns 14, a plurality of cross beams 16, a plurality of substantially vertically oriented supports 18, a plurality of rafters 20, and at least one roof panel 22. The columns 14 extend from the floor 12 wherein each column includes a floor end 24 and a roof end 26 positioned opposite the floor end 24. The cross beams 16 connect at least two of the columns 14 and the supports 18 extend from the cross beams 16 opposite the column 14. Two of the rafters 20 are attached to the supports 18 and are preferably positioned on opposite sides of the supports 18. The roof panels 22 span between two of the rafters 20.

Each floor end 24 of the columns 14 includes a column keyway 28 that corresponds in design to the floor keyway 30 positioned in the floor 12. The floor keyway 30 and column keyway 28 are designed to engage one another and restrict movement between the column 14 and floor 12. Preferably the column keyways 28 are grooves and the floor keyways 30 are protuberances.

The floor 12 includes a plurality of footing sections 32 wherein each footing section 32 is positioned under one of the columns 14. At least one poured pad 34 extends between the footing sections 32. A top layer 36 is positioned over each footing section 32 wherein each top layer 36 is positioned substantially planar with the pad 34. Preferably the top layer 36 and pad 34 do not overlap and the floor keyways 30 are positioned in the top layers 36.

Each column 14 can include at least two dowels 38 wherein each dowel 38 includes an upper end 40 and a lower end 42. Each upper end 40 is integrally formed within and extending from the floor end 24 of one of the columns 14 and each lower end 42 is integrally formed within the floor 12, more specifically the footing section 32. The lower end 42 of each dowel 38 is bent substantially perpendicular to the upper end 40 to increase the secured connection between the column 14 and floor 12.

A plurality of walls 44 is also included. Each wall 44 is connected to the column keyway 28 to secure the walls 44 to the columns 14. The walls 44 also separate the storage building 10 into bays to allow separation of the various materials stored in the storage building 10.

The building further includes a penthouse 46, or top 46, and a material distribution equipment 48 positioned in the penthouse 46. The material distribution equipment distributes materials within the building 10 and into the various bays formed by the walls 44.

A substantially horizontally oriented bearing plate 50 is positioned on the roof end 26 of each column 14. Each bearing plate 50 includes substantially vertically oriented bars 52 wherein the bars 52 are integrally formed within the roof end 26. Each cross beam 16 is connected to at least one of the bearing plates 50 and is preferably welded to one of the bearing plates 50. Also included is a plurality of connection plates 54 wherein each connection plate 54 is positioned above one of the roof ends 26 and attaches adjacent cross beams 16.

The attachment between the bars 52, the bearing plates 50 and the roof end 24 of the columns 14 in combination with the attachment between the bearing plate 50 and the cross beam 16 with the continued connection between the cross beam 16 via the connection plate 54 adds significant structural integrity to the building 10. This construction design allows for the roof ends 26 of the columns 14 to transfer pressure to other columns 14 which permit each bay, or compartment, formed by the walls 44 and columns 14 to stand alone. The side pressures through the walls 34 are transferred through the cross beams 16 through their weld to the bearing plates 50 and attachment through the connection plate 54 to adjacent cross beam 16. Additionally the keyway connections between the walls 44 and columns 14 further enhance the connection and pressure transfer between various walls 44 and columns 14. The cross beams 16 further support the columns 14, walls 44, rafters 20, and roof panels 22 through the multiple plates and keyways.

Referring now to FIG. 1, a general schematic of a building 10 made in accordance with the current disclosure is shown.

The top 46, or penthouse 46, is shown generally positioned at the highest portion of the building 10 and approximately in the center of the storage area of the building 10. The penthouse 46 includes the material distribution equipment 48 positioned therein such that there is a material dump height of approximately 50 feet. In one embodiment this dump height is approximately 52 feet, The distance from the floor 12 of the building 10 to the highest portion 47 of the penthouse 46 can vary according to required storage capacity. In one embodiment it is approximately 62 feet tall.

The external walls of the building 10 can be white fiberglass panels which allow light to permeate through providing some ambient light inside the building 10. Thirty pound felt and 50 year shingles can be positioned on the roof panels 22. The metal portions of the building construction, such as the cross beams 16, bearing plates 50, connection plates 54 and any hardware connecting those items, can include two coats of rust resistant primer and an additional coat of foam to protect these elements from the materials stored in the building 10. The columns 14 can be 3'×3' reinforced concrete plaster.

Figure 2:
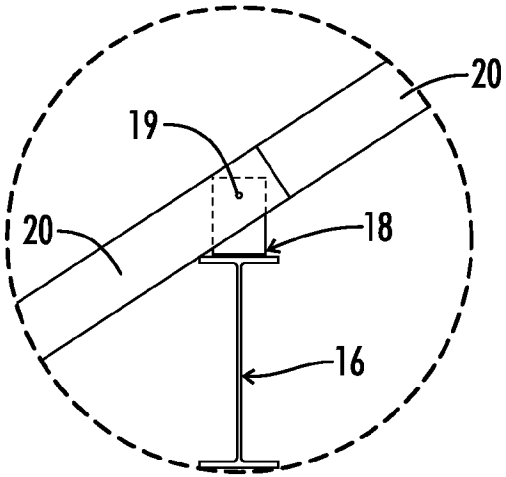
FIG. 2 is a detailed view of the items circled and labeled as numeral 2 in FIG. 1.

Now looking at FIG. 2, an example of interaction between the rafters 20, supports 18, and cross beams 16 is shown. The support 18 is shown extending upward from the cross beams 16 with rafters 20 positioned on each side. The support 18, or clip 18, is sandwiched between the upper and lower rafter portions 20 and includes a fastener 19, such as a stainless steel bolt, running through each rafter 20 and support 18 to secure the three pieces together. The support 18 is preferably welded to the cross beam 16.

Figure 3:
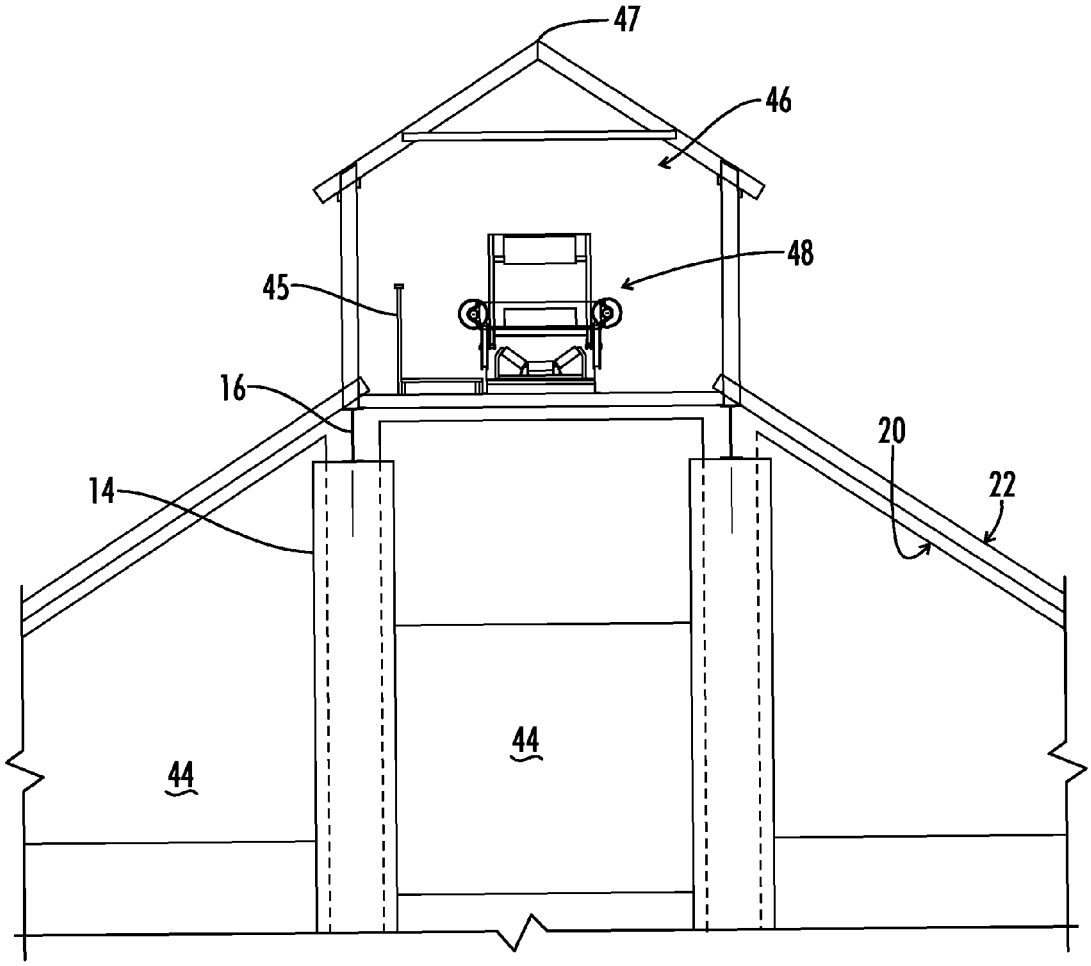
FIG. 3 is a detailed schematic view of the top of a building made in accordance with the disclosure including an example of material handling equipment.

Now turning to FIG. 3, a more detailed view of the penthouse 46 is shown. The penthouse 46 is designed for the material handling equipment 48, which is preferably built by Newbern Fabricating, Inc. out of Newbern, Tenn. This can include a catwalk 45 used for the safety of the operators in the penthouse during the loading of material.

Figure 4:
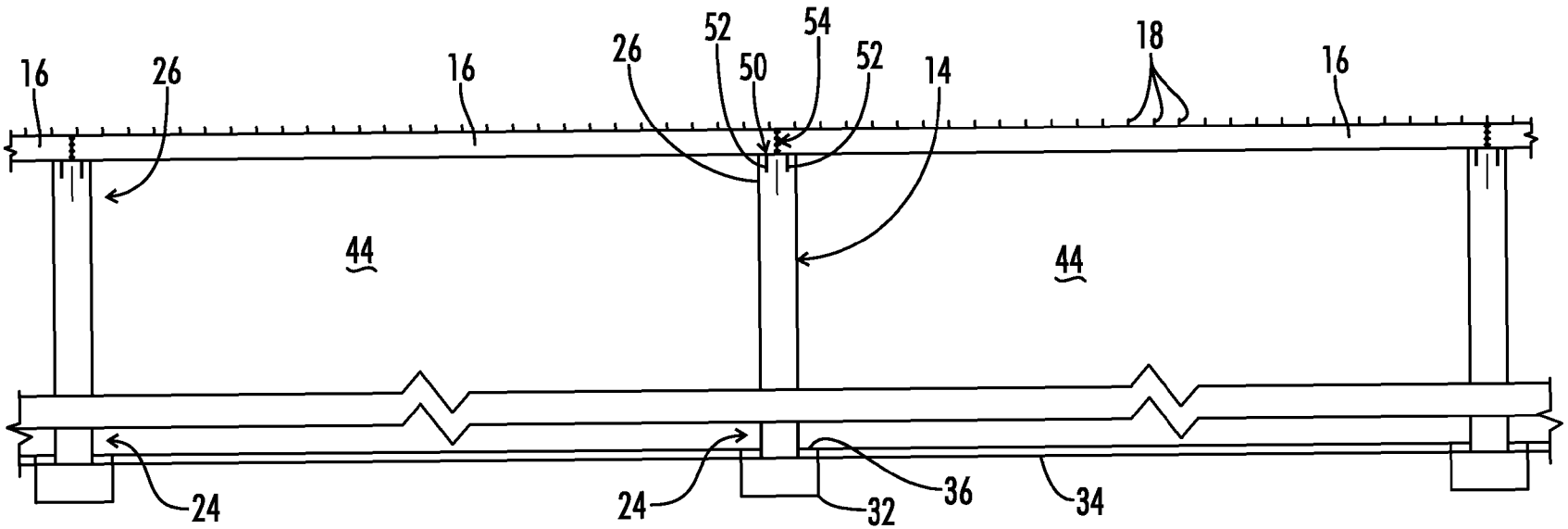
FIG. 4 is a partial detailed schematic view of a building made in accordance with the current disclosure showing the relationship between the walls, crossbeams, columns and floor.

Now referring to FIG. 4 a partial schematic of the columns 14, cross beams 16 and walls 44 is shown. The walls 44 are shown spanning the distance between the columns 14. The cross beams 16 also span between the columns 14 and are connected by a connection plate 54 to adjacent cross beams 16 and to the column 14 by the bearing plate 50. A space can be left between the bottom of the walls and floor for maintenance.

Figure 5:
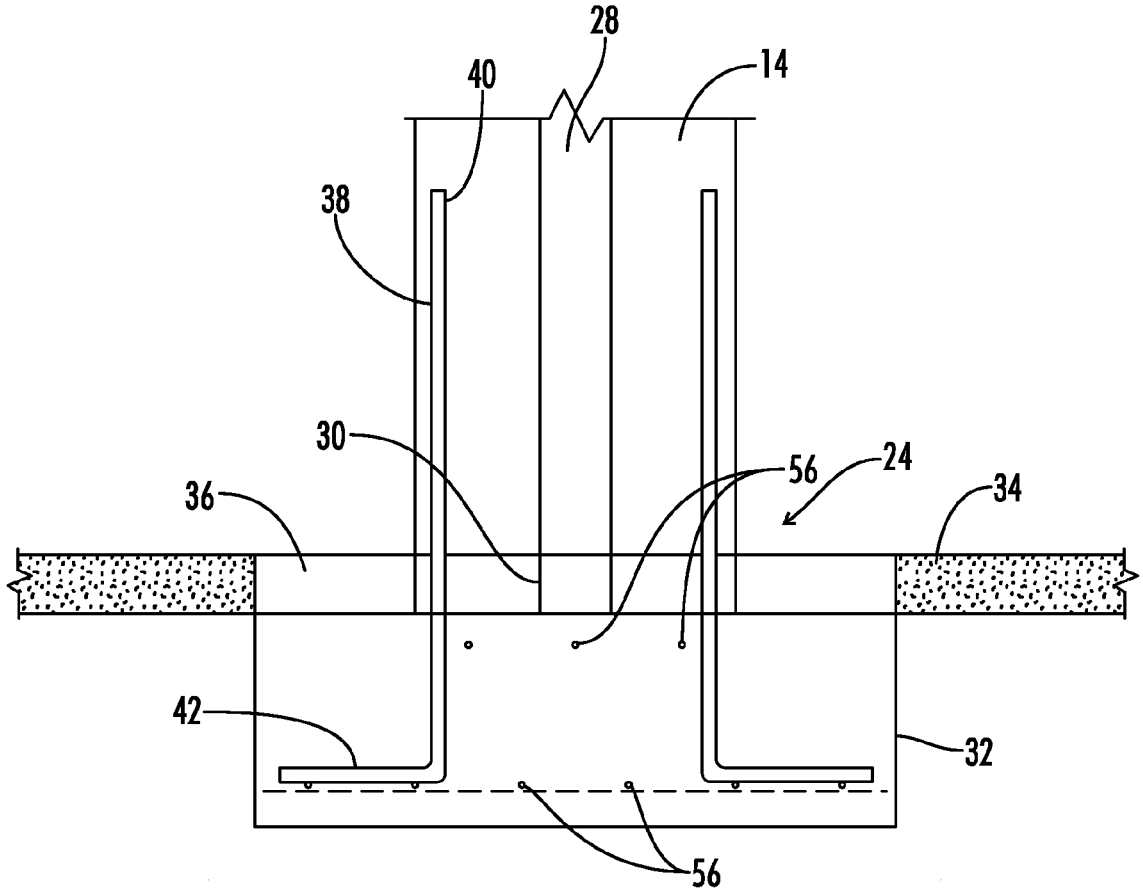
FIG. 5 is a partial schematic detail view of the interaction between the floor end of a column and the floor.

Now referring to FIG. 5, a partial detailed view of a section of the floor 12 and the interaction of the floor 12 to the column 14 is shown. This figure shows the footing section 32 positioned under the column 14 with the top layer 36 positioned on the footing section 32. The pad 34 is shown positioned adjacent the top layer 36 while the dowels 38 are shown integrally formed within the column 14 and the footing section 32. Additional reinforcement rebar 56 can be included in the footing section 32 to increase the stability thereof. The column keyway 28 is shown interacting with the floor keyway 30.

Figure 6:
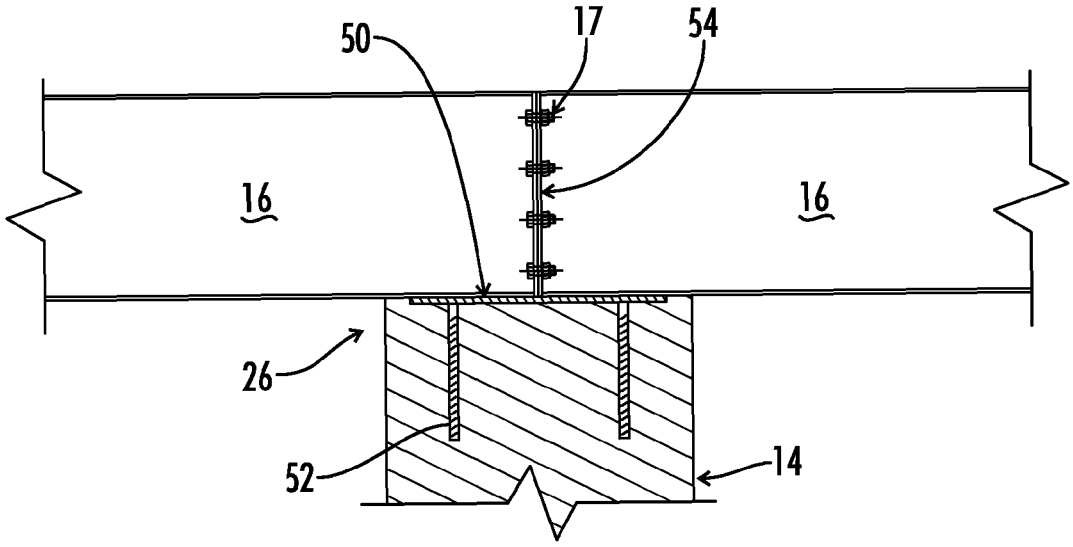
FIG. 6 is a partial detailed schematic view of the roof end of a column showing the interaction between the cross beams connection plate, bearing plate and roof end.

Now looking at FIG. 6, a partial detailed schematic view of the roof end 26 of a column 14 is shown. Adjacent cross beams 16 are shown attached to fasteners 17, which can be bolts, and connection plate 54. The bearing plate 50 is shown welded to the cross beam 16 with the bars 52 integrally formed in the roof end 26 to the column 14.

Figure 7:
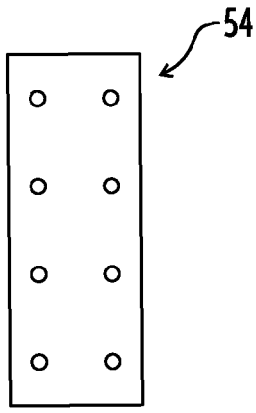
FIG. 7 is a top view of an example of a connection plate made in accordance with the current disclosure.
Figure 8:
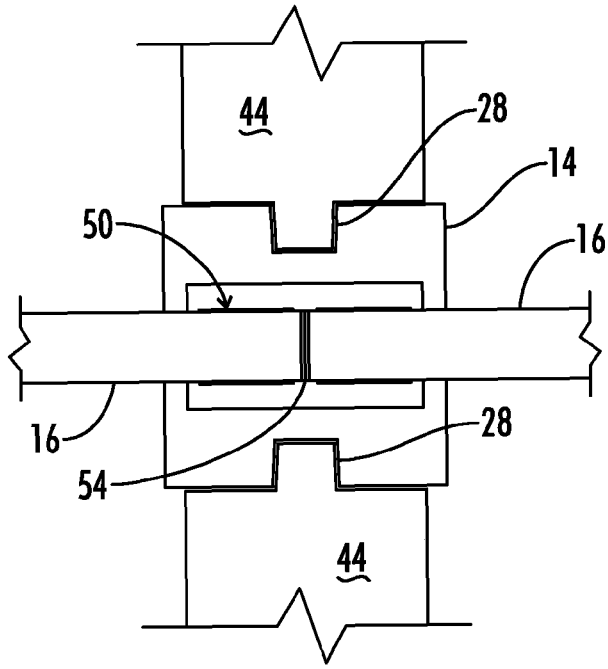
FIG. 8 is a partial top schematic view of a roof end of a column showing interaction between the walls, column, cross beam, bearing plate and connection plate.

Now looking at FIG. 7, a detailed schematic view of the interaction shown in FIG. 6 and in addition the interaction between a column 14 and the walls 44 is shown. This figure shows the walls 44 interacting with the column keyway 28 to form a strong engagement between the walls 44 and the column 14. The cross beams 16 are shown attached to the bearing plate 50 which is on top of the columns 14. The connection plate 54 is shown connecting the two cross beams 16.

An advantage of the building 10 over traditional bulk storage buildings is the invented building's ability to store material in a deeper, or higher pile, and to do so substantially over the full footprint of the building 10. The invented building 10 can store material greater than 40 feet high and in some cases over 50 feet high with an angle of repose between approximately 30 degrees to approximately 60 degrees, and in a preferred embodiment 31 degrees. The improved building can have the walls 44 and columns 14 withstand the bearing pressure substantially completely to the top 46 of the building. This results in more material being able to be stored in a smaller footprint of the building 10. This results in less floor space and roof space to cover that amount of material 10.

Preferably the building design is specific for chemical fertilizer and other corrosive materials. As such, the above mentioned specifications are preferably used in the construction of the building 10. This includes the use of coated material and stainless steel material in combination with poured concrete.

Additionally, a feature of the building 10 includes the "floating floor" concept. This uses the combination of pad 34, top layer 36 and floating sections 32 to reduce the bearing pressure on the footing sections 32 to less than approximately 2,000 pounds per square inch. In a preferred embodiment this pressure can be reduced to less than approximately 1,300 pounds per square inch.

The combination of the above listed advantages can result in a large savings to owners and/or builders that follow the current inventive design. This savings occurs in the capability of the current building 10 to store more tons of material for a given amount of square foot of floor space. For example, following the current design, an invented building can store upwards of an additional one ton of material per square foot of floor space. This can result in upwards of a minimum of $65,000 worth of storage capacity savings combined with the use of less land in the building construction. Additional savings are realized in the compartmentalized material handling equipment in the penthouse location thereby reducing the length of this material handling equipment as compared to traditional storage buildings.

Thus, although there have been described particular embodiments of the present invention of a new and useful Improved Bulk Storage Building, it is not intended that such references be construed as limitations upon the scope of this invention except as set forth in the following claims.

What is claimed is:

1. A storage building for the storage of corrosive materials, the storage building comprising:

a floor having a perimeter, a plurality of footing sections, a top layer, a pad extending between footing sections, and a plurality of floor keyways;

a plurality of concrete columns, each concrete column extending from the floor and positioned over one of the footing sections, the plurality of columns including a row of first columns, a row of second columns, and a row of third columns, at least one row of columns spaced from the perimeter and each row of columns increasing in height, each column including:

a plurality of column keyways shaped to engage the floor keyways to restrict movement between said column and the floor;

a floor end; and a roof end positioned opposite the floor end, the roof end including a substantially horizontally oriented bearing plate having substantially vertically oriented bars recessed within the roof end;

a plurality of cross beams, each beam secured to the bearing plate of adjacent columns in adjacent rows, connecting one of the columns in one of the rows to the adjacent column in the adjacent row, and positioned to transmit forces between adjacent cross beams and adjacent columns;

a plurality of substantially vertically oriented supports, each support extending from one of the cross beams and positioned opposite the column;

a plurality of rafters, wherein at least two of the rafters are oppositely attached to one of the supports in a position parallel to each other, each rafter connecting at least two columns wherein each of said connected columns is in a different row and the connections are positioned to transmit forces between adjacent columns in adjacent rows;

at least one roof panel spanning between two of the rafters;

a plurality of walls, each wall connected to the column keyway of at least two adjacent columns at a keyway connection, the keyway connection shaped to transmit forces between the adjacent columns in the same row;

at least two dowels, each dowel including an upper end and a lower end, each upper end integrally formed within and extending from the floor end and each lower end integrally formed within the floor; and wherein the bearing plate and the plurality of cross beams are composed of corrosive resistant material.

2. The storage building of claim 1, wherein the column keyways are grooves and the floor keyways are protuberances.

3. The storage building of claim 1, wherein the top layer and the pad do not overlap.

4. The storage building of claim 1, wherein the positioning of the top layer, footing sections, and pad reduces the pressure on the footing sections by the materials to less than approximately 2,000 pounds per square inch.

5. The storage building of claim 4, wherein the positioning of the top layer, footing sections, and pad reduces the pressure on the footing sections by the materials to less than approximately 1,300 pounds per square inch.

6. The storage building of claim 1, wherein the lower end of each dowel is substantially perpendicular to the upper end.

7. The storage building of claim 1, wherein the connection of plurality of walls to adjacent columns separates the storage building into bays.

8. The storage building of claim 1, wherein the storage building can store corrosive materials approximately 50 feet high with an angle of repose between approximately 30 degrees to approximately 60 degrees.

9. The storage building of claim 1, further including a top and material distribution equipment positioned substantially at the top for distribution of the materials into the building.

10. The storage building of claim 1, further including a plurality of connection plates, each connection plate positioned above one of the roof ends and attaching adjacent cross beams.

11. A storage building for the storage of corrosive materials, the storage building comprising:

a floor including:

a plurality of footing sections;

a perimeter;

at least one pad extending between the footing sections; and a top layer positioned over each footing section, each top layer positioned adjacent to and substantially planar with the at least one pad and each top layer including a floor keyway;

a plurality of concrete columns spaced on the floor, the plurality of columns including a row of first columns, a row of second columns, and a row of third columns, with at least one row of columns spaced from the perimeter, each column positioned over one of the footing sections and including:

a floor end engaging one of the footing sections;

a roof end positioned opposite the floor end;

a column keyway shaped and positioned to correspond with the floor keyway to restrict movement between said column and the floor;

a plurality of dowels, each dowel including and upper end and a lower end, each upper end integrally formed within and extending from the floor end and each lower end integrally formed within the floor and positioned substantially perpendicular to the upper end; and a substantially horizontally oriented bearing plate having substantially vertically oriented bars integrally formed within the roof end;

a plurality of cross beams, each beam secured to the bearing plate of adjacent columns in adjacent rows, connecting one of the columns in one of the rows to the adjacent column in the adjacent row, and positioned to transmit forces between adjacent cross beams and adjacent columns;

a plurality of walls, each wall connected to the column keyway of at least two adjacent columns at a keyway connection, the keyway connection shaped to transmit forces between the adjacent columns in the same row;

a plurality of substantially vertically oriented supports, each support extending from one of the cross beams and positioned opposite the column;

a plurality of rafters, wherein two of the rafters are attached to one of the supports in a parallel alignment, each rafter connecting at least two columns wherein each of said connected columns is in a different row and the connections are positioned to transmit forces between adjacent columns in adjacent rows;

at least one roof panel spanning between the two rafters; and wherein the bearing plate and the plurality of cross beams are composed of corrosive resistant material.

12. The storage building of claim 11, wherein the storage building can store corrosive materials approximately 50 feet high with an angle of repose between approximately 30 degrees to approximately 60 degrees.

13. The storage building of claim 11, wherein the positioning of each top layer, footing section, and pad reduces the pressure on the footing sections by the materials to less than approximately 1,300 pounds per square inch.

14. The storage building of claim 11, further including a plurality of connection plates, each connection plate positioned above one of the roof ends and attaching adjacent cross beams.

15. The storage building of claim 11, wherein keyway connection of the plurality of walls to the columns and separates the storage building into bays.

16. A storage building for the storage of corrosive materials, the storage building comprising:

a floor including:

a plurality of footing sections;

a perimeter;

at least one pad extending between the footing sections; and a top layer positioned over each footing section, each top layer positioned adjacent to and substantially planar with the at least one pad and each top layer including a floor keyway;

a plurality of concrete columns, each concrete column extending from the floor and positioned over one of the footing sections, the plurality of columns including a row of first columns, a row of second columns, and a row of third columns, with at least one row of columns spaced from the perimeter, each column including:

a floor end engaging one of the footing sections;

a roof end positioned opposite the floor end:

a column keyway shaped and positioned to correspond with the floor keyway to restrict movement between said column and the floor;

a plurality of dowels, each dowel including an upper end and a lower end, each upper end integrally formed within and extending from the floor end and each lower end integrally formed within the floor and positioned substantially perpendicular to the upper end; and a substantially horizontally oriented bearing plate having substantially vertically oriented bars integrally formed within the roof end;

a plurality of cross beams, each beam secured to the bearing plate of adjacent columns in adjacent rows, connecting one of the columns in one of the rows to the adjacent column in the adjacent row, and positioned to transmit forces between adjacent cross beams and adjacent columns;

a plurality of substantially vertically oriented supports, each support extending from one of the cross beams and positioned opposite the column;

a plurality of rafters, wherein two of the rafters are attached to one of the supports, each rafter connecting at least two columns wherein each of said connected columns is in a different row and the connections are positioned to transmit forces between adjacent columns in adjacent rows;

at least one roof panel spanning between the two rafters;

a plurality of connection plates, each connection plate positioned above one of the roof ends and attaching adjacent cross beams;

a plurality of walls, each wall is connected to the column keyway of at least two adjacent columns at a keyway connection, the keyway connection shaped to transmit forces between the adjacent columns in the same row and to separate the storage building into bays; and wherein the bearing plate and the plurality of cross beams are corrosive resistant.

* * * * *